350-445 SR
XR 3,968,497

United State
Bui Hai

[11] 3,968,497
[45] July 6, 1976

[54] ANTENNA WITH A PERISCOPE ARRANGEMENT

[75] Inventor: Nhu Bui Hai, Paris, France

[73] Assignee: Thomas-CSF, Paris, France

[22] Filed: Mar. 14, 1975

[21] Appl. No.: 558,545

[30] Foreign Application Priority Data

Mar. 19, 1974 France ..... 74.09212

[52] U.S. Cl. ..... 343/781 CA; 343/786; 343/761

[51] Int. Cl.[2] ..... H01Q 19/14

[58] Field of Search ..... 343/781, 782, 786, 837, 343/840, 781 A, 781 CA, 779, 761

[56] References Cited

UNITED STATES PATENTS

| | | | |
|---|---|---|---|
| 3,641,577 | 2/1972 | Tocquec | 343/786 |
| 3,821,746 | 6/1974 | Mizusawa et al. | 343/781 |
| 3,845,483 | 10/1974 | Soma et al. | 343/781 |

OTHER PUBLICATIONS

1970 G-AP International Symposium, Columbus, Ohio, (14-16 Sept., 1970), pp. 400-406.

IEEE Transactions on Antennas and Propagation, Nov. 1973, Communication, (pp. 884-886).

*Primary Examiner*—Alfred E. Smith
*Assistant Examiner*—Tommy P. Chin
*Attorney, Agent, or Firm*—Cushman, Darby and Cushman

[57] ABSTRACT

In an antenna of the Cassegrainian or Gregorian type including a periscope arrangement, the auxiliary reflector has a longer focal distance than the auxiliary reflector of a conventional antenna of this type and the length of the optical path between the auxiliary reflector and the primary source of the antenna is choosen substantially equal to the distance between the auxiliary reflector and that one of its two foci which is the more remote therefrom. This makes it possible to use only plane mirrors in the periscope arrangement.

6 Claims, 3 Drawing Figures

3968497
OR IN 343/781CA

ANTENNA WITH A PERISCOPE ARRANGEMENT

The present invention relates to an antenna comprising, in series, as concerns the optical path, a primary source, a periscope arrangement with n mirrors, an auxiliary twofocus reflector and a main reflector, the main reflector being arranged between the auxiliary reflector and the periscope arrangement.

Antennas of this kind are known, which are derived from a conventional Cassegrainian or Gregorian type of structure by locating the primary source farther away from the auxiliary reflector and using the periscope arrangement to maintain illumination of the auxiliary reflector by the primary source. In order to enable the primary source, although it has been moved away, to continue to be located at a point of focus of the antenna, at least one of the mirrors of the periscope arrangement is a convergent mirror.

Because of the presence of these convergent mirrors, the periscope arrangements are expensive, difficult to adjust and reduce the decoupling of the antenna.

The present invention has been devised in order to overcome these drawbacks.

The result is achieved by a modification of the conventionaly used auxiliary reflector, making it possible to use only plane mirrors.

In accordance with the invention, there is provided an antenna comprising, in series as concerns the optical path: a primary source, a periscope arrangement with n (n being a positive integer) mirrors, said n mirrors being successively arranged along said path and being all plane mirrors, an auxiliary reflector having two foci and a main reflector; said main reflector being physically located between said auxiliary reflector and said periscope arrangement; said two foci being located at either side of said main reflector and the distance between said auxiliary reflector and that one of its two foci which is the more remote from said auxiliary reflector, being substantially equal to the length of the optical path between said auxiliary reflector and said primary source.

The invention will be better understood and other of its features rendered apparent, from a consideration of the ensuing description and the related three figures which illustrate schematic sectional views of three antennas in accordance with the invention.

In these three figures, corresponding elements have been designated by the same references.

Figure 1:
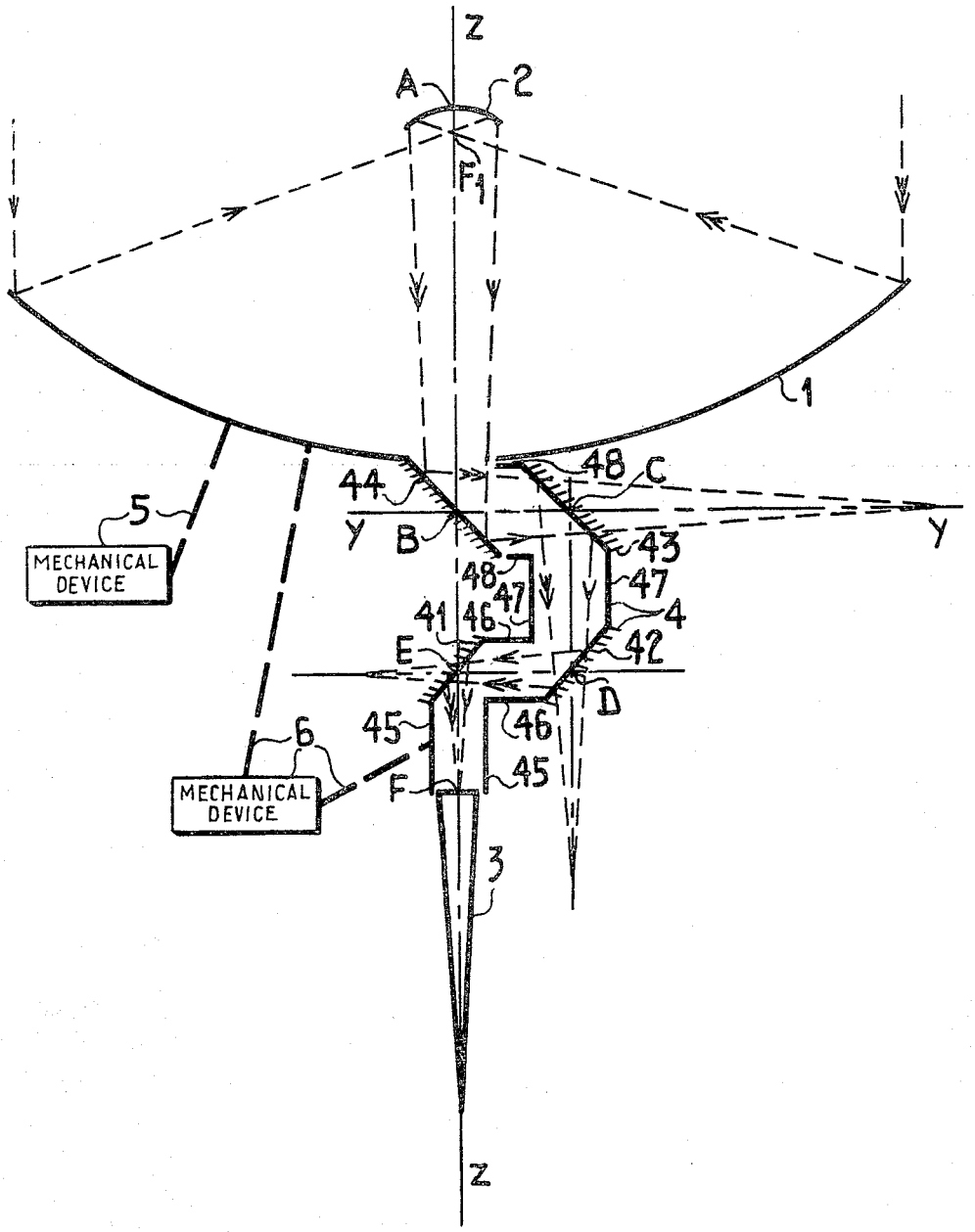
FIG. 1 is an antenna of the Cassegrainian or Gregorian type, illustrating one embodiment of the periscope arrangement comprises plane mirrors.

FIG. 1 illustrates a Gregorian type of antenna, that is to say one having an auxiliary reflector 2 of ellipsoid design. This antenna can be displaced in elevational and azimuthal planes; in addition to the auxiliary reflector 2, it comprises a main reflector 1, a primary source 3, a periscope arrangement 4 and two mechanical devices 5, 6.

The primary source 3 will advantageously be a corrugated horn; the horn propagation axis is coincidental with the axis ZZ shown by the antenna for an elevational angle of 90°; FIG. 1 illustrates an antenna position corresponding to an angle of 90° in elevation.

The main reflector 1 is a paraboloid whose axis is common with that of the auxiliary reflector 2 and whose focus coincides with that, $F_1$, of the two auxiliary reflector foci which is nearest to said auxiliary reflector; when the antenna occupies an elevational angle of 90°, this common axis is coincidental with the axis ZZ.

The periscope arrangement 4 comprises four plane mirrors, 41 to 44, delimiting, together with four duct sections 45, 46, 47, 48, a channel arranged as shown on the drawing, which channel is designed to protect the interior of the periscope arrangement against the effects of the weather.

The three mirrors 41 to 43 are inclined at 45° in relation to the axis ZZ and the same applies to the mirror 44 when the elevational angle of the antenna is 90°.

The antenna can be orientated azimuthally by rotation of all its elements, with the exception of the primary source, about the axis ZZ; this rotation is performed by means of the mechanical device 6 symbolised by a rectangle and two broken lines.

The antenna is also orientatable in elevation by rotation of the system constituted by the mirror 44, the main reflector 1 and the auxiliary reflector 2; the axis of this rotation is an axis YY perpendicular to that ZZ at a location where the latter passes through the mirror 44, and, with the mirror 44 in the position corresponding to an elevational angle of 90°, this axis YY defines with the axis ZZ a plane perpendicular to the plane of the mirror 44. The mechanical device 5, symbolised by a rectangle and one broken line, is responsible for elevational rotation; this mechanical device 5, like the mirror 44 and the reflectors 1 and 2, rotates as a function of the azimuthal motion controlled by the mechanical device 6.

In the plane of FIG. 1, the two extreme rays (marked respectively by a single arrow and a double arrow) of a beam picked up by the antenna, illustrate the path of a wave through the antenna. For the antenna to be able to operate, it is necessary, of course, that the two extreme rays should converge on the horn 3 when they arrive. If ABCDEF is the trajectory of a beam between the auxiliary reflector 2, the mirrors 44, 43, 42, 41 and the source 3, then this is tentamount to saying that the path should be substantially equal to the distance between the auxiliary reflector and that one its two foci which is the more remote from this auxiliary reflector. The conventional auxiliary reflector must thus be substituted by an auxiliary reflector with a longer focal distance.

It should be noted, furthermore, that the mirrors which can be made of metal or of a laminated material covered with zinc or other metals, are mounted on supports, not shown in the drawing, which make it possible to adjust their position. On the other hand, to enable this adjustement to take place, a small mirror for visible light it attached to the centre of each of the mirrors 41 to 44.

By way of example, an antenna of the type shown in FIG. 1, has been designed to operate in a frequency band ranging from 11 to 14 kmc. The dimensions of this antenna are as follows:

| | |
|---|---|
| - diameter of the main reflector | 15 m |
| - focal length of the main reflector | 5.25 m |
| - diameter of the auxiliary reflector | 2 m |

-continued

- focal length of the auxiliary reflector 15 m
- primary source of corrugated horn type, having an apex angle of 7.7°, an aperture of 0.732 m and a length of 5.42 m.

Figure 2:
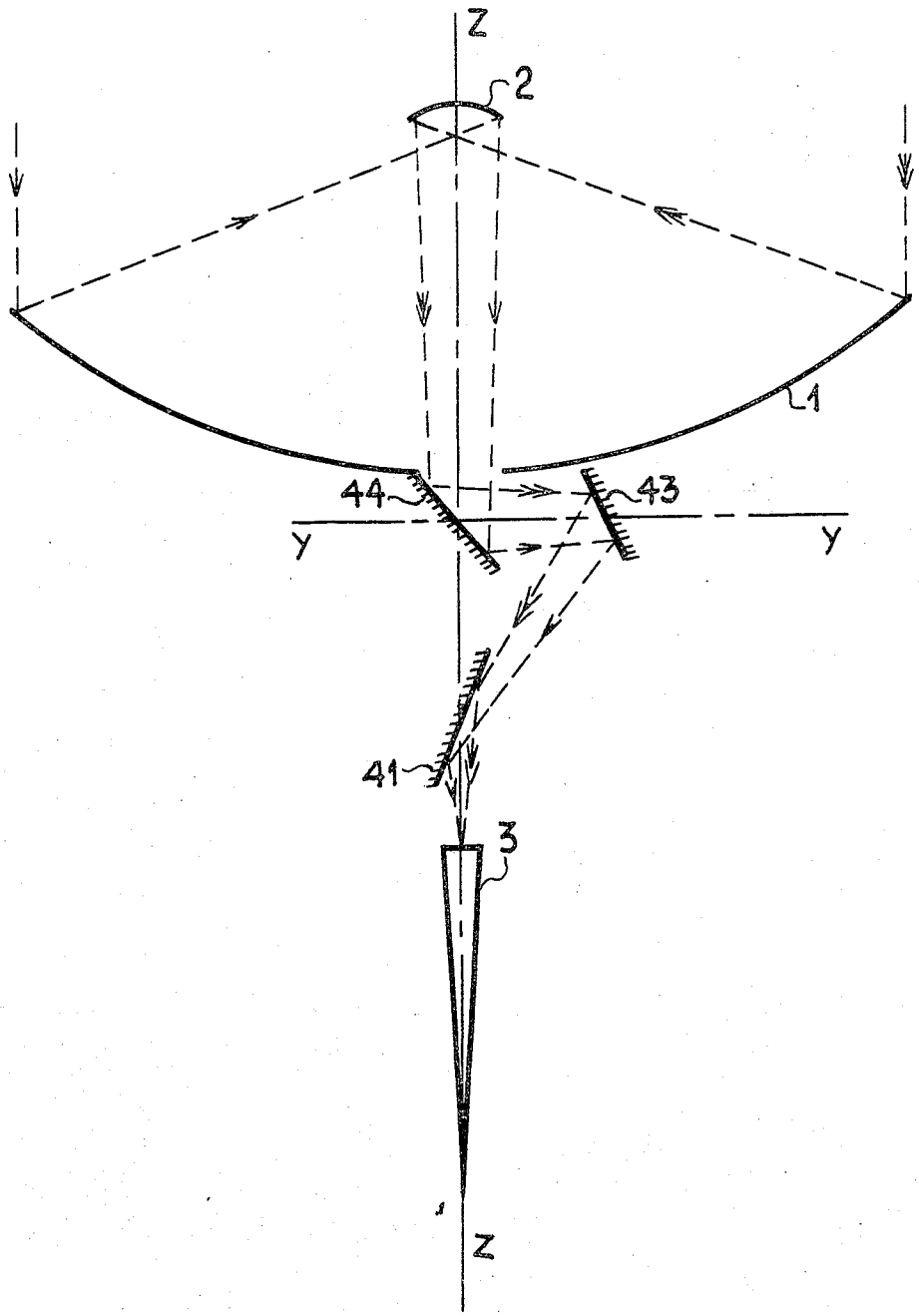
FIG. 2 is an antenna with another embodiment of the periscope arrangement.

FIG. 2 illustrates, minus the protective channel of the periscope arrangement, an antenna which differs from that shown in FIG. 1 simply by the reduction to three in the number of mirrors and by the arrangement of these three mirrors.

The three mirrors 41, 43 and 44 of the periscope arrangement of this antenna are not inclined at the same angle to the axis ZZ. If the mirror 44 is inclined at around 45°, the two other mirrors 43 and 41 are inclined to a lesser degree so that the primary source 3 can always be arranged on the axis ZZ and thus remains fixed both for azimuthal displacements and for elevational displacements of the antenna.

Figure 3:
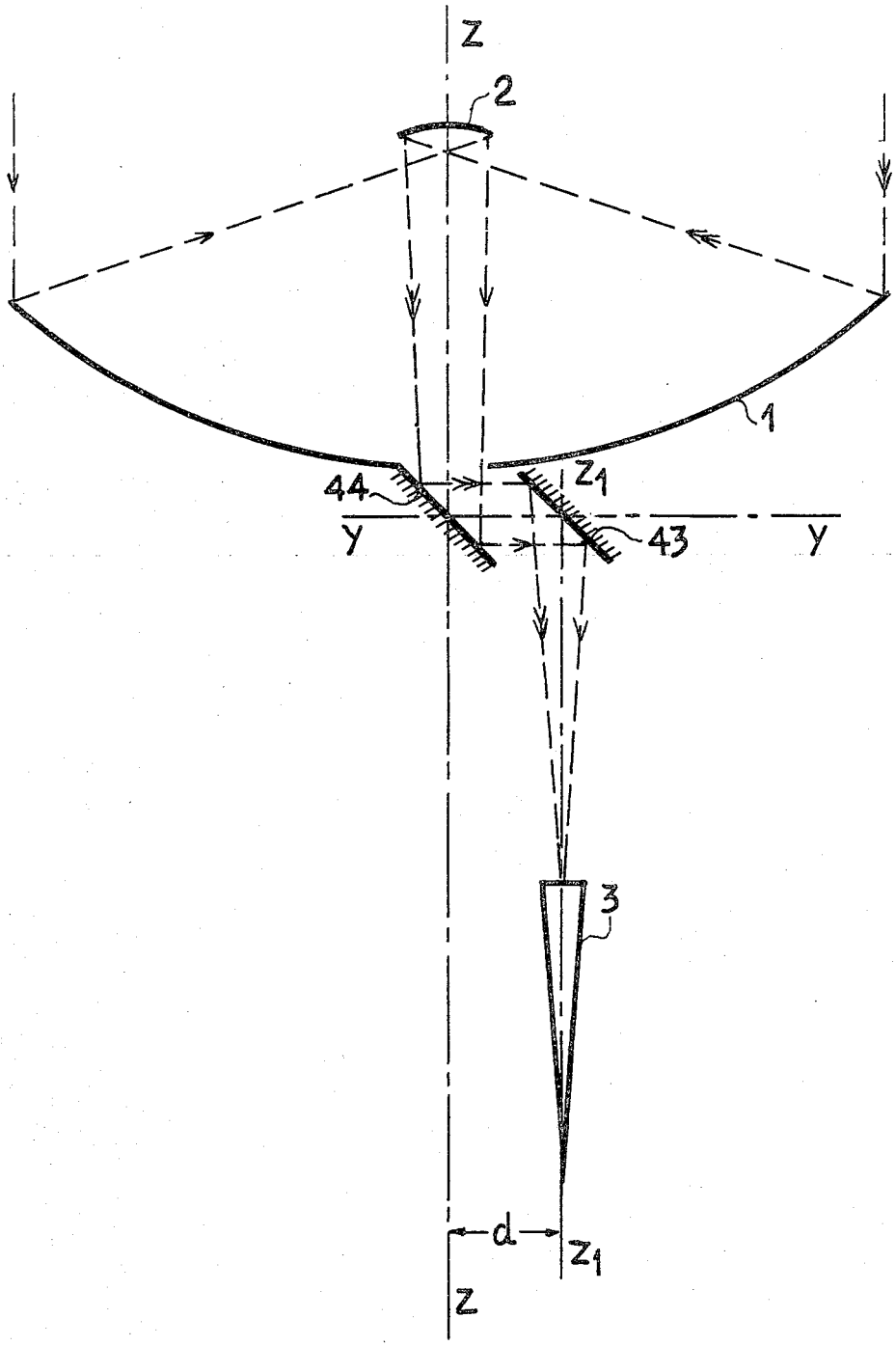
FIG. 3 is an antenna with a further embodiment of the periscope arrangement in that the axis of rotation in azimuth is relatively offset.

FIG. 3 illustrates, minus the protective channel of the periscope arrangement, an antenna which differs from the antenna shown in FIG. 1 in that the number of mirrors is reduced to two (mirrors 43 and 44) and in that the axis $Z_1Z_1$ of rotation in azimuth is offset relatively to the axis ZZ which the antenna adopts for an elevational angle of 90°. Thus the number of mirrors and the offset d in the azimuthal axis of rotation of the periscope arrangement of an antenna, can be determined in an optimum way, as a function of the rear structure of the main reflector and of the location at which the control cabin is disposed.

Self-evidently, the invention is not limited to the three examples described and the number of mirrors in the periscope arrangement could be greater than four, or again could be less than two in which latter case, however, the primary source is not fixed: it rotates with the azimuthal motion. In the case of a periscope arrangement having only one mirror, in relation to the antenna of FIG. 1 there would be a reduction in the mirrors to the single mirror 44 and the primary source 3 would have a different position; this latter would be arranged on the axis YY with its aperture disposed towards the mirror 44 and at an interval from the latter equal to the length represented in the drawing by the trajectory BCDEF; the elevational and azimuthal motions would then take place about axis YY and ZZ but, as already mentioned, the primary source would rotate as a function of the azimuthal motion.

It should be pointed out, too, that it is possible to design antennas in accordance with the invention, which are fixed; this, amongst other things, is of significance in determining the position of the control cabin as a function of the rear structure of the main reflector.

In addition, the invention has been described in the assumption that the main reflectors and auxiliary reflectors are perfect cones; but these reflectors will, preferentially, and according to known art, be given a certain conformation, that is to say their profile slightly modified. This profile modification is designed, as far as the auxiliary reflector is concerned, to render the amplitude distribution of the incident wave uniform and, as far as the main reflector is concerned, to correct the phase differences which result from the modification to the auxiliary reflector.

Of course, the invention is not limited to the embodiments described and shown which were given solely by way of example.

What is claimed is:

1. An antenna comprising, in series, for defining a radiation path: a primary source, a periscope arrangement with *n* (n being a positive integer) successive mirrors, said *n* mirrors being successively arranged along said path and being all plane mirrors, an auxiliary reflector having first and second foci, the distance between said first focus and the auxiliary reflector being smaller than the distance between said second focus and the auxiliary reflector, and a main reflector having a reflecting face; said main reflector being physically located between said auxiliary reflector and said periscope arrangement; said first and second foci being respectively located in front of and behind the reflecting face of said main reflector and said distance between said second focus and said auxiliary reflector being substantially equal to the length of that part of said radiation path which is comprised between said auxiliary reflector and said primary source.

2. An antenna as claimed in claim 1, having an azimuthal rotation axis, in which each of said reflectors is a surface substantially symmetric in relation to an axis, referred to as the common axis, which is the same for both reflectors, wherein n is at least equal to 2 and wherein said primary source is fixed and has an axis of propagation which is coincidental with said azimuthal rotation axis.

3. An antenna as claimed in claim 2, wherein the last one of said n mirrors along said radiation path, considered starting from said primary source, forms with said reflectors an integral assembly, said antenna further comprising a mechanical device for controlling the orientation in elevation, of said antenna, through driving said assembly.

4. An antenna as claimed in claim 2, wherein *n* is a positive even number and wherein, when the antenna is in the position corresponding to an elevation angle of 90°, *n*/2 of said n mirrors are orientated in a first direction, and the other *n*/2 of said n mirrors in a second direction, said first and second directions being symmetrical with each other in relation to said azimuthal rotation axis.

5. An antenna as claimed in claim 2, wherein n is at least equal to 3 and wherein, when the antenna is in a position corresponding to an elevational angle of 90°, said azimuthal rotation axis is coincidental with said common axis.

6. An antenna as claimed in claim 2, wherein n is equal to 2 and wherein, when the antenna is in a position corresponding to an elevational angle of 90°, said azimuthal rotation axis is offset in relation to said common axis.

* * * * *